US006702024B2

(12) United States Patent
Neugebauer

(10) Patent No.: US 6,702,024 B2
(45) Date of Patent: Mar. 9, 2004

(54) DUAL ENERGIZED HYDROSEAL

(75) Inventor: Thomas W. Neugebauer, Houston, TX (US)

(73) Assignee: Cilmore Valve Co., Ltd., Houston, TX (US)

( * ) Notice: Subject to any disclaimer, the term of this patent is extended or adjusted under 35 U.S.C. 154(b) by 45 days.

(21) Appl. No.: 10/017,097

(22) Filed: Dec. 14, 2001

(65) Prior Publication Data

US 2003/0111227 A1 Jun. 19, 2003

(51) Int. Cl.[7] ..... E21B 47/00
(52) U.S. Cl. ..... 166/321; 166/169; 166/334.4
(58) Field of Search ..... 166/319–321, 166/323, 334.4, 264, 167, 169

(56) References Cited

U.S. PATENT DOCUMENTS

| | | | | |
|---|---|---|---|---|
| 2,358,228 A | | 9/1944 | Hoof | |
| 2,445,505 A | | 7/1948 | Ashton | |
| 2,485,504 A | | 10/1949 | Morgan | |
| 2,506,111 A | | 5/1950 | Saint | |
| 2,647,810 A | | 8/1953 | McCuistion | |
| 3,654,962 A | | 4/1972 | Fredd et al. | |
| 3,917,220 A | | 11/1975 | Gilmore | |
| 4,253,481 A | | 3/1981 | Sarlls, Jr. | |
| 4,266,614 A | | 5/1981 | Fredd | |
| 4,793,590 A | | 12/1988 | Watson | |
| 4,856,557 A | | 8/1989 | Watson | |
| 4,903,765 A | * | 2/1990 | Zunkel | 166/162 |
| 5,058,674 A | | 10/1991 | Schultz et al. | |
| 5,103,906 A | | 4/1992 | Schultz et al. | |
| 5,337,822 A | | 8/1994 | Massie et al. | |
| 5,410,919 A | | 5/1995 | Carpenter et al. | |
| 5,464,036 A | * | 11/1995 | Tomkins et al. | 137/315 |
| 5,662,166 A | * | 9/1997 | Shammai | 166/264 |
| 5,771,931 A | | 6/1998 | Watson | |
| 5,901,749 A | | 5/1999 | Watson | |
| 6,029,744 A | | 2/2000 | Baird | |
| 6,186,477 B1 | | 2/2001 | McCombs et al. | |

OTHER PUBLICATIONS

Parker Hannifin Corporation; Parker O–Ring Handbook; ORD5700A USA; 7–99; Lexington, KY (undated).
Apple Rubber Products Inc.; Seal Design Catalog; Lancaster, NY,(undated).
Gilmore Valve Co., Drawing No. 25082, Dirty Fluid Valve 2–Way, NC; Aug. 24, 1992.

* cited by examiner

*Primary Examiner*—William Neuder
(74) *Attorney, Agent, or Firm*—Blackwell Sanders Peper Martin, LLP

(57) ABSTRACT

A bi-directional seal assembly can be used in various types of cartridge valves including dirty fluid valves and a variety of other valves. The present seal assembly utilizes a seal spool, two O-rings and opposing seal cups. The O-rings are compressed during manufacture of the seal assembly and the valve more than typically recommended by O-ring manufacturers. Because of this compression, the O-rings serve a dual function. At lower pressures, the O-rings act as a spring causing the seal cups to contact the opposing seal plates and at higher pressures they act as seals between the seal assembly and the valve.

30 Claims, 6 Drawing Sheets

DUAL ENERGIZED HYDROSEAL

BACKGROUND OF THE INVENTION

1. Field of the Invention

The present seal assembly will function when pressure acts on it from two different directions. It is therefore sometimes referred to as a bi-directional seal or a dual energized hydroseal. The present invention can be used in a variety of different types of valves where a dual energized seal assembly is needed, as well as in cases where single-direction control is necessary.

2. Background of the Invention

The dual energized hydroseal includes a seal spool, two O-rings and two opposing seal cups. This bi-directional seal assembly can be used in a dirty fluid valve and a variety of other applications where a bi-directional seal assembly is needed, as well as in cases where a single direction seal assembly is necessary. For purposes of example, the dual energized hydroseal will be described in a dirty fluid valve, which is a type of cartridge valve frequently used in downhole tools. A plurality of dirty fluid valves are positioned in a downhole tool that is used for sampling wellbore fluids. A plurality of empty sample collection bottles are located in the downhole tool. When the tool is inserted in the wellbore, all of the dirty fluid valves are in the closed position as shown in FIG. 1. When the downhole tool reaches a depth that needs to be sampled, a pilot valve is pulsed, causing the seal carrier to slide the dual energized hydroseal assembly along opposing seal plates and open the supply port, as shown in FIG. 2. This allows wellbore fluids to enter the supply port of the dirty fluid valve and move through the longitudinal passageway of the valve and out the function port to a sample collection bottle. A plurality of sample collection bottles are often included in a single tool so that the wellbore may be sampled at different depths.

External pressures in a wellbore often exceed 20,000 psi absolute. After a sample has been collected, a pilot valve is pulsed, causing the seal carrier to move back to the close position as shown in FIG. 1. The pressure inside the sample collection bottle is the same as the pressure in the wellbore at the collection depth. As the downhole tool is brought back to the surface, external pressure drops to standard atmospheric pressure, but the pressure inside the sample collection bottle remains at wellbore pressure, which may be in excess of 20,000 psi absolute.

The present seal assembly will function when pressure acts on it from two different directions. The present invention can be used in a variety of different types of valves. When the seal assembly of the present invention is constructed, the O-rings are squeezed into position and/or compressed approximately 40%. The squeeze of the O-rings causes them to act as springs urging the seal cups into contact with the opposing seal plates. By contrast, O-ring manufacturers such as Parker generally recommend that O-rings be squeezed axially approximately 20%–30% for static seal designs. The present invention is a static seal design. Other O-ring manufacturers, such as Apple, recommend that O-rings be squeezed axially for static seal in the range of approximately 25%–38%. Squeezing the O-rings more than recommended by most manufacturers improves the function in the present invention. The O-rings in the present invention perform a dual function as both the spring and the seal. They act as a spring to force the seal cups into contact with the opposing seal plates, at lower pressures and they act as a seal at higher pressures.

U.S. Pat. No. 5,662,166 to Shammai, discloses an apparatus for maintaining at least downhole pressure of a fluid sample of upon retrieval from an earthbore. The Shammai device has a much more complex series of seal than the present invention. Further, the Shammi device does not have a dual-energized seal like the present invention.

U.S. Pat. No. 5,337,822 issued to Massie et al., discloses a wellfluid sampling tool. The Massie device maintains samples at the pressure at which they are obtained until they can be analyzed. The device does not, however, maintain this pressure by means of a dual-energized hydroseal. Rather, the device of Massey uses a hydraulically driven floating piston, powered by high-pressured gas such as nitrogen acting on another floating piston, to maintain sample pressure.

SUMMARY OF THE INVENTION

The seal assembly of the present invention uses two O-rings that are squeezed more than 38.5% causing them to act as springs urging the seal cups into sealing engagement at very low pressures with the seal plates and as seals at higher pressures. At higher pressure a seal is achieved because pressure on the rear of the seal cups forces them into sealing engagement with the opposing seal plates. The pressure forces act on the seal cups to achieve a tight metal to metal seal. The bi-directional seal assembly of the present invention is shown in a dirty fluid valve which is positioned in a downhole tool for sampling wellbore fluids. The seal assembly of the present invention can be used in a variety of other types of valves that require bi-directional seal assemblies and in other types of valves that only require a uni-directional seal.

DESCRIPTION OF THE INVENTION

Figure 1:
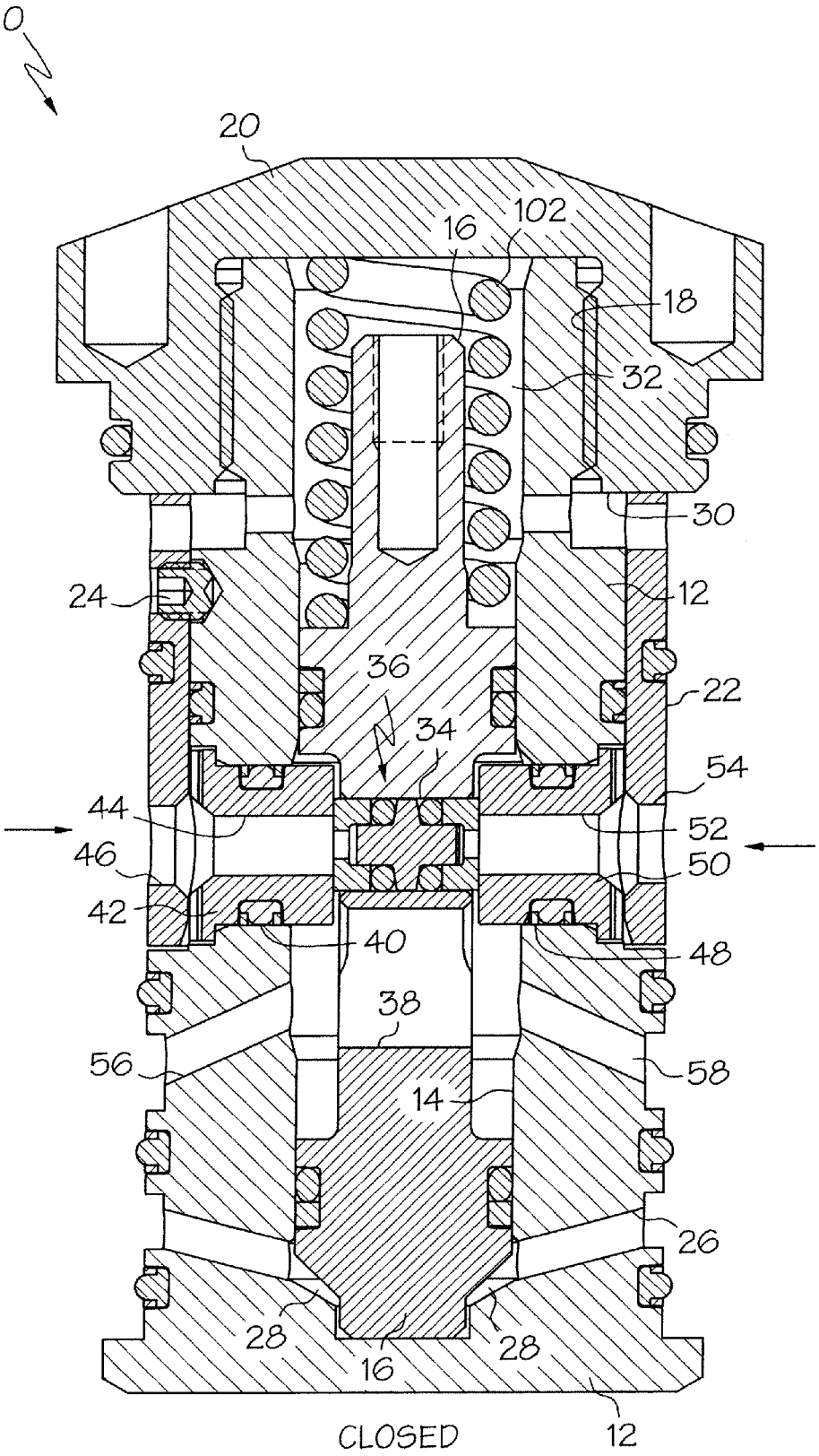
FIG. 1 is a section view of a valve with the dual energized hydroseal. The valve is in the closed position in an unpressurized state.

Referring to FIG. 1, the dirty fluid valve is generally identified by the numeral 10. The valve 10 is a normally closed, two position, two-way valve. The valve 10 is sometimes referred to as a "cartridge" type valve, because it is often manufactured in the configuration of FIG. 1 and it is slipped into a valve chamber in the body of a downhole tool. The downhole tool typically have—or more dirty fluid valves, to test wellbore fluids at different well depths. Each valve 10 is in fluid communication with the wellbore and a sample collection bottle to hold wellbore fluids. The valve 10 is typically rated for operational pressures of up to 30,000 psi and temperatures of up to 350° F.

The valve 10 has a generally cyndrical body 12 which defines a longitudinal bore 14 which is sized and arranged to receive a seal carrier 16. The seal carrier moves from a normally closed position shown in FIG. 1 to an open position shown in FIG. 2.

The body 12 has threads 18 formed on one end to threadably engage the cap 20. A cylinder cover 22 surrounds a portion of the body 12. The cylinder cover 22 is rotationally held in place on the body by a set screw 24 and longitudinally in place by cap 20.

The body 12 defines an open pilot port 26 which is in fluid communication with an open chamber 28. The body 12 and the cylinder cover 22 define a close pilot port 30 which is in fluid communication with the close chamber 32 which is defined by the longitudinal bore 14 in body 12, the cap 20 and the seal carries 16. The open pilot port 26 is in fluid communication with a pilot open valve, not shown. The close pilot port 30 is in fluid communication with a pilot close valve, not shown. Both pilot valves are connected to a source of pressurized pilot fluid, not shown.

The seal carrier 16 has a transverse bore 34 sized and arrange to receive a bi-directional seal assembly generally identified by the numeral 36. A transverse flow passageway 38 is also formed in the seal carrier 16 to facilitate fluid flow through the valve when it is in the open position.

A bore 40 is formed in the body 12 and is sized and arranged to receive the first seal plate 42. A through bore 44 is formed in the seal plate 42 and is in fluid communication with a supply port 46 formed in the cylinder cover 22.

A bore 48 is formed in the body 12 and is sized and arranged to receive the second seal plate 50. A through bore 52 is formed in the seal plate 50 and is fluid communication with a supply port 54 formed in the cylinder cover 22. For purposes of claim interpretation, the body 12 and the cylinder cover 22 may collectively be referred to as the body, although for manufacturing convenience, they are produced as two separate parts.

When the downhole tool is placed in the wellbore, pressures may reach 30,000 psi, depending on the depth of the well. Wellbore fluids exert this "supply pressure" as indicated by the arrow in FIG. 1.

Figure 2:
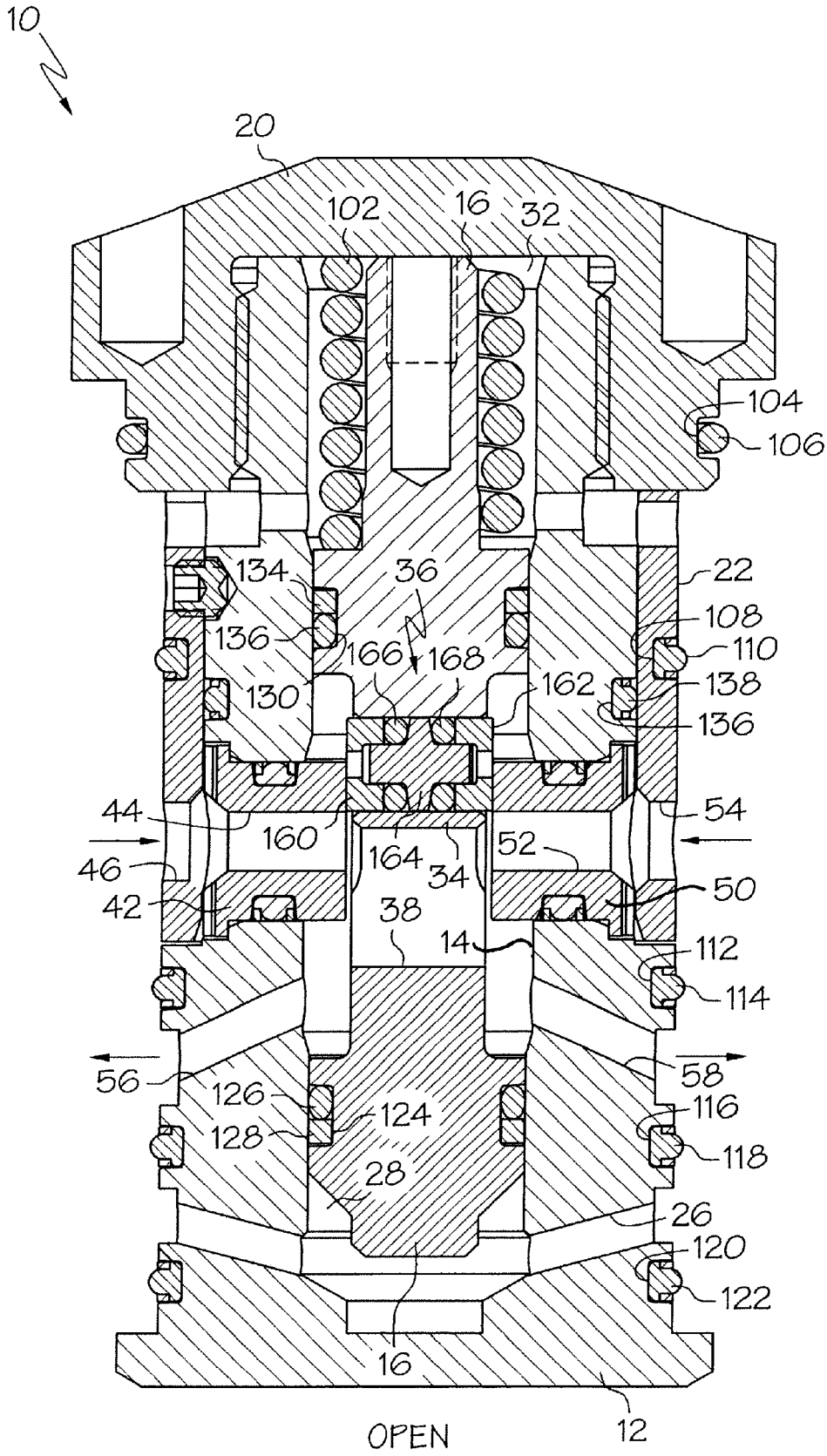
FIG. 2 is a section view of the valve of FIG. 1 except the valve is in the open position and Fluid is shown flowing through the valve by the flow arrows.

To shift the valve 10 from the closed position of FIG. 1 to the open position of FIG. 2, the pilot open valve is actuated allowing pilot pressure to enter the open port 26 and the open chamber 28. The force of the pressurized pilot fluid acting on the seal carrier 16 shifts it to the open position of FIG. 2.

Referring to FIG. 2, the valve 10 is shown in the open position. Wellbore fluids indicated by the flow arrows, pass through the open ports 46 and 54 of the cylinder cover 22 and the through bore 44 and 52 of seal plates 42 and 50. The wellbore fluids then pass through the flow passageway 38 in the seal carrier 16, the longitudinal bore 14 and out the function ports 56 and 58, as indicated by the flow arrows, to the sample collection bottle, not shown. After the sample has been taken, the pilot close valve is actuated and pressurized pilot fluid enters the close port 30 and the close chamber 32. The pilot fluid is typically pressurized in the range of 1,500 to 10,000 psi. The force of this pilot fluid on the seal carrier causes it to shift from the open position of FIG. 2 to the closed position of FIG. 1. A spring 102 is positioned in the close chamber 32. A typical spring rate for the valve 10 is 261 lb./in. The spring 102 urges the seal carrier 16 into the normally closed position of FIG. 1.

An O-ring groove 104 is formed in the cap 20 and is sized and arranged to receive O-ring 106 which seals the cap 20 against the valve chamber in the downhole tool. A groove 108 is formed in the cylinder cover 22 and is sized and arranged to receive T-seal 110 which seals the cylinder cover 22 against the valve chamber in the downhole tool.

A groove 112 is formed in the body 12 and is sized and arranged to receive T-seal 114. A groove 116 is formed in the body 12 and is sized and arranged to receive T-seal 118. A groove 120 is formed in the body 12 and is sized and arranged to receive T-seal 122. T-seals 114 and 118 seal and isolate the function port 56 against the valve chamber in the downhole tool, not shown. T-seals 118 and 122 seal and isolate the pilot open port against the valve chamber in the downhole tool, not shown.

A groove 124 is formed in the seal carrier 16 and is sized and received to receive an O-ring 126 and a lock-up ring 128. The O-ring 126 and backup ring 128 seal and isolate the open chamber 28 from the other flow passageways in the valve 10.

A groove 130 is found in the other end of the seal carrier 16 and is sized and arranged to receive an O-ring 132 and backup ring 134. The O-ring 132 and backup ring 134 seal and isolate the close chamber 32 from the other flow passageways in the valve 10.

The bi-directional seal assembly generally identified by the numeral 36 is positioned in the transverse bore 36 of seal carrier 16. The seal assembly functions when supply pressure (pressure from wellbore fluids) enters the through bore 44 of first seal plate 42 and the through bore 52 of seal plate 50 and is applied to the seal assembly 36. The seal assembly also functions when function pressure (from the sample collection bottle) enters the longitudinal bore 14, and the transverse bore 34 in the seal carrier 16 and is applied to the seal assembly 36. The seal assembly 36 is therefore referred to as "bi-directional" because it functions when exposed to both supply pressure (pressure from wellbore fluids in the well) and function pressure (pressure from the stored wellbore fluids in the sample collection bottle).

The seal assembly 36 includes a first seal cup 160, a second seal cup 162, a seal spool 164, a first O-ring 166 and a second O-ring 168.

Figure 3:
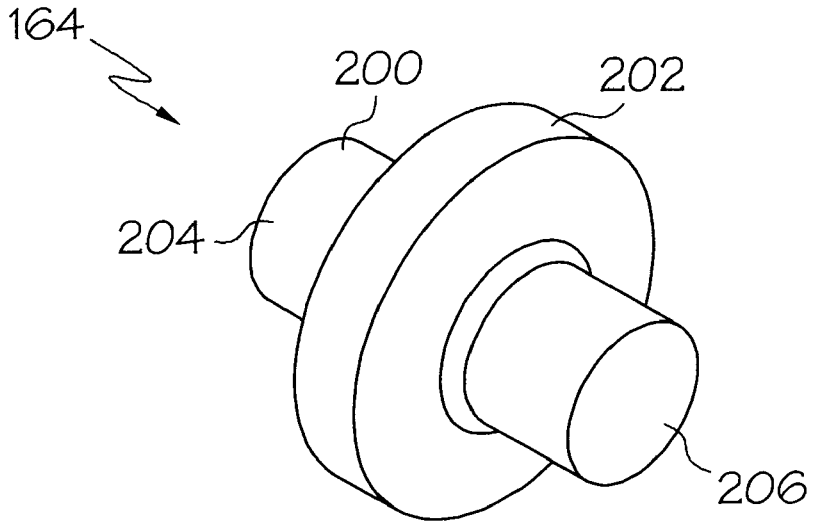
FIG. 3 is a perspective view of the seal spool.

Referring to FIG. 3, the seal spool 164 is shown in perspective view. The seal spool 164 has a central axle 200 bisected by a circular collar 202. The axle 200 has a first end 204 and a second opposing end 206.

Figure 4:
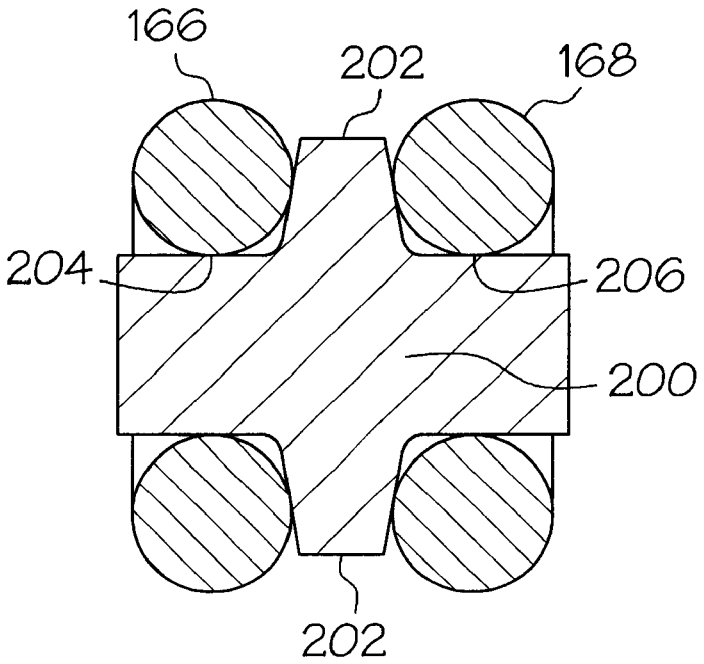
FIG. 4 is an enlarged section view of the seal spool and O-rings in a relaxed position.

Referring to FIG. 4, the seal spool 164 is shown in section view with two O-rings, 166 and 168. The O-ring 166 fits on the first end 204 of axle 200 and the second O-ring 168 fits on the second end 206 of the axle 200. The circular collar 202 is formed on an angle of approximately 10°.

O-rings are used in two basic applications generally referred to as "static" and "dynamic" by those skilled in the art. The O-rings 166 and 168 in the bi-directional seal assembly 36 are considered as static. In a static seal, the mating gland parts are not subject to relative movement. In the present invention, the transverse bore 34, the seal spool 164, and the seal cups 160 and 162 are nonmoving.

O-ring manufacturers, for example Parker Seals of Parker Hannifin Corp. of Lexington, Ky., generally recommend that some squeeze be applied to O-rings for maximum sealing effectiveness. Squeeze can be either axial or radial. The O-rings 166 and 168 shown in FIG. 4 are in a relaxed state. However, when placed in the seal assembly 36 in the transverse bore 34, the O-rings are typically squeezed axially more than the amount typically recommended by O-ring manufacturers.

In the present invention, a Parker No. 2-004 O-ring is suitable for use as O-rings 166 and 168. These O-rings are formed from Buna-N 90 durometer material and the maximum operational temperature suggested by Parker is 350° F. Applicants recommend an axial squeeze of 40% or more. The July 1999 Parker O-ring Handbook Design Chart 4-2, a copy of which is included in the Information Disclosure Statement, filed concurrently herewith recommends an axial squeeze for No. 2-004 through 050 of 19 to 32 percent. Design chart 4-2 is for static O-ring sealing. Other O-ring manufacturers, for example, Apple Rubber Products of Lancaster, N.Y., recommends an axial squeeze for an O-ring with a 0.070 cross-section of between 25.5 and 38.5 percent for a static seal. (See page 17 of the Apple Rubber Products Seal Design Catalog, portions of which are included in the Information Disclosure Statement filed concurrently herewith).

Figure 5:
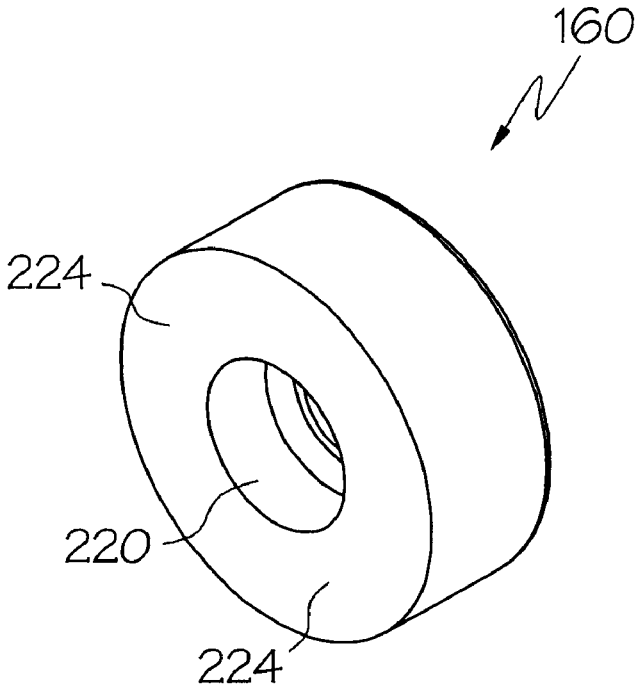
FIG. 5 is a perspective view of one seal cup.
Figure 6:
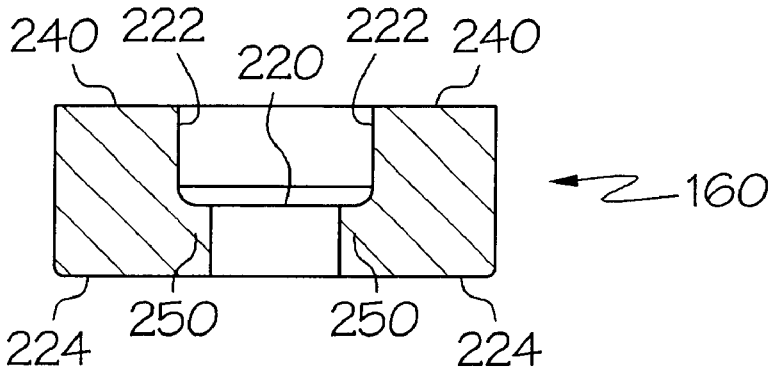
FIG. 6 is an enlarged cross sectional view of one seal cup.

Referring to FIG. 5 and FIG. 6, the first seal cup 160 is shown. The first seal cup 160 has a through bore 220 a portion 222 of which is sized and arranged to receive the first end 204 of the axle 200 of seal spool 164. The seal cup 160 has a flat sealing surface 224 that seals against flat sealing surface 226 of first seal plate 42.

Figure 7:
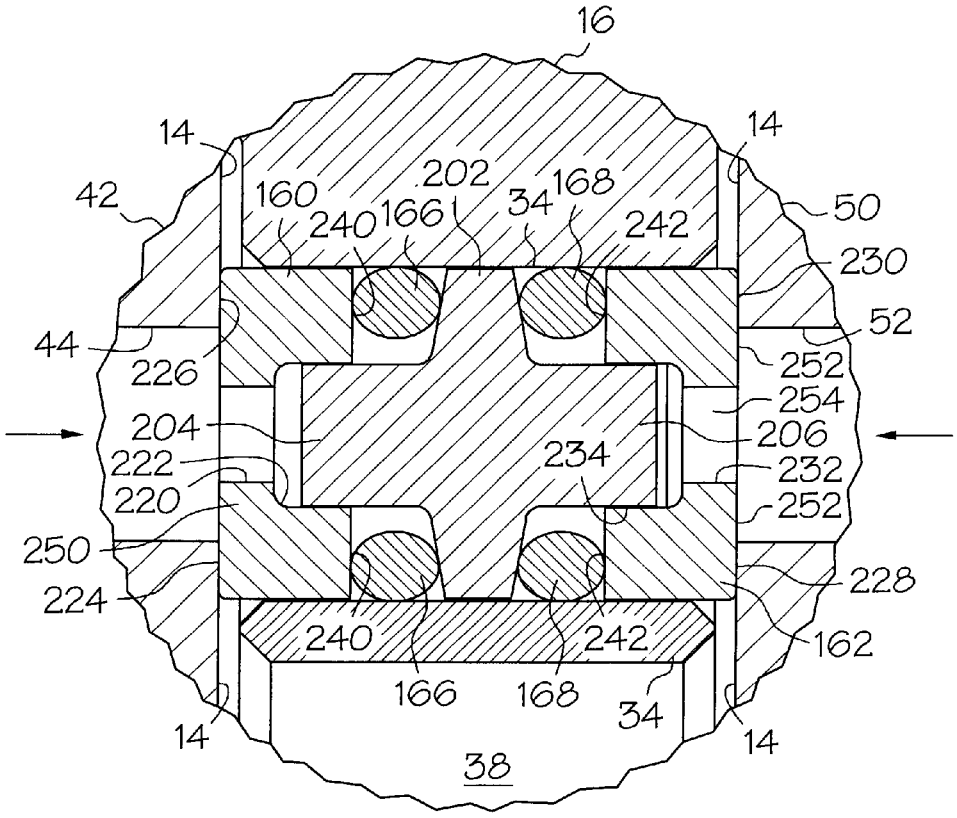
FIG. 7 is an enlarged cross sectional view of the dual energized hydroseal exposed to supply pressure.

Referring to FIG. 7, an enlarged section view of the seal assembly 36 is shown. O-rings 166 and 168 are squeezed axially about 40% or more against the collar 202 by the seal cups 160 and 162. The second seal cup 162 has a flat sealing surface 228 formed thereon to seal against an opposing flat sealing surface 230 of seal plate 50. Seal cup 162 has a through bore 232, a portion 234 of which is sized and arranged to receive the second end 200 of the axle.

In FIG. 7, the arrows indicate supply pressure (from wellbore fluids) that passes through bore 44 in the seal plate 42 and bore 220 in first seal cup 160 urging O-ring 166 away from first axle portion 204 and against the transverse bore 34. Likewise supply pressure (from wellbore fluids) passes through bore 52 in seal plate 50 and bore 232 in second seal cup 162, urging O-ring 168 away from second axle portion 206 and against the transverse bore 34. As O-rings 166 and 168 deform against the id of the transverse bore, the supply pressure exerts force against the rear surface 240 of first seal cup 160 and the rear surface 242 of second seal cup 162. This supply pressure exerted on rear surfaces 240 and 242 creates a metal to metal seal between the seal cup 160 and seal plate 42 and seal cup 162 and seal plate 50.

After the valve 10 has been opened and wellbore fluids, sometimes at pressures as much as 20,000 psi are stored in the sample collection bottle, the downhole tool is removed from the hole. At the surface, pressure on the outside of the tool at seal level is one atmosphere, but the pressure in the sample collection bottle will still be at wellbore pressure, perhaps 20,000 psi. For this reason the seal assembly 36 must be bi-directional and be able to seal when function pressure from the sample collection bottle exceeds ambient pressures surrounding the downhole tool.

Figure 8:
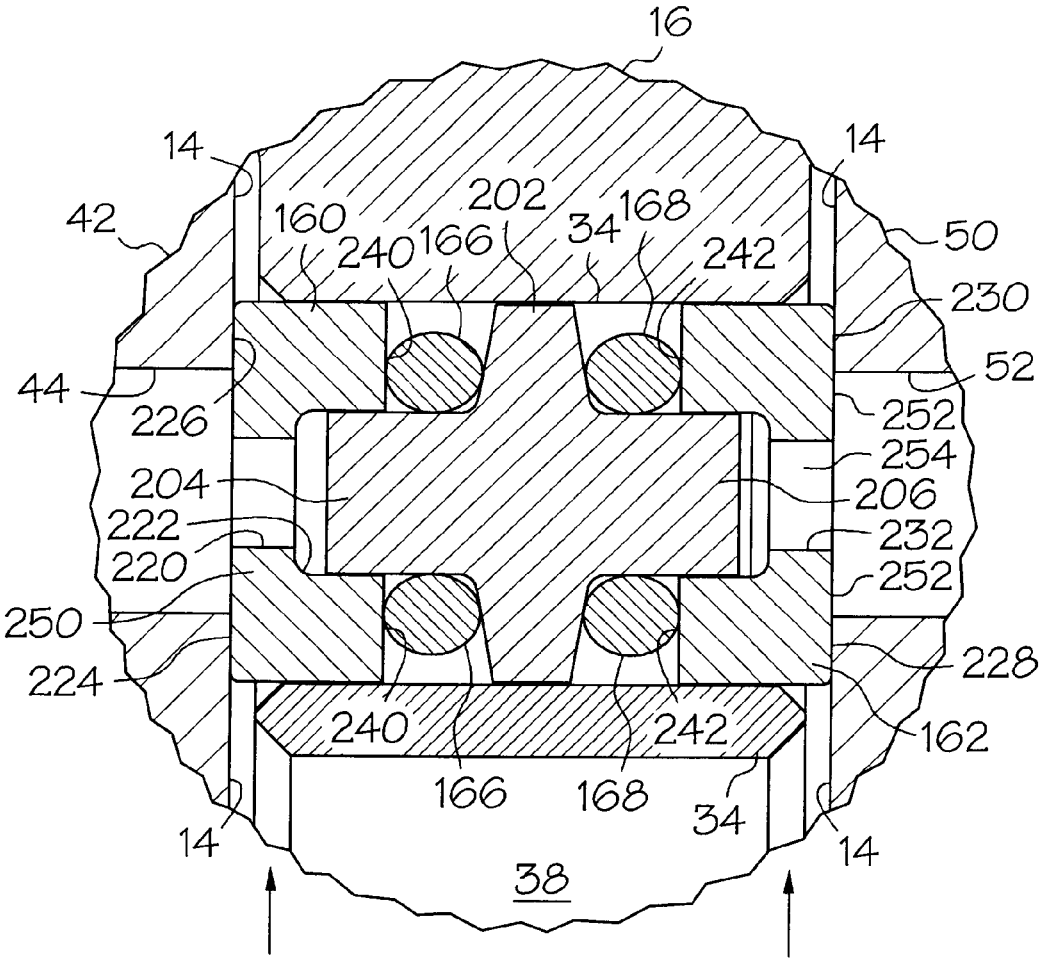
FIG. 8 is an enlarged cross sectional view of the dual energized hydroseal exposed to function pressure.

In FIG. 8, the arrows indicate function pressure (from the sample, collection bottle) that passes through the longitudinal bore 14 and passes between the transverse bore 34 and first seal cup 160 and second seal cup 162, urging O-rings 166 and 168 into contact with axle portions 204 and 206 and away from transverse bore 34. As O-ring 166 and 168 deform against the id of the axle portions 204 and 206, function pressure exerts force against the rear surface 240 of seal cup 160 and the rear surface 242 of seal cup 162. The function pressure exerted on rear surfaces 240 and 242 creates a metal-to-metal seal between the seal cup 160 and seal plate 42 and seal cup 162 and seal plate 50.

O-rings 166 and 168 are squeezed axially more than the amount recommended by the manufacturers because the O-rings 166 and 168 perform actual purpose. First, the O-rings 166 and 168 act as springs and second, they act as seals. At low pressures, it is important to ensure that first seal cup 160 engages first seal plate 42 at low pressures. Because O-ring 166 is squeezed axially, it exerts force against the seal cup 160 like a spring to ensure contact. However, sealing between seal cup 160 and seal plate 42, at higher pressure, is due to forces exerted on the rear 240 of the seal cup 160 by either supply or function pressure.

Likewise it is important to ensure that second seal cup 162 engages second seal plate 50 at low pressures. Because O-ring 168 is squeezed axially, it exerts force against the seal cup 162 like a spring to ensure contact. However sealing between seal cup 162 and seal plate 50, at higher pressures, is due to forces exerted on the rear 242 of the seal cup 162 by either supply or function pressure.

In FIGS. 7 and 8, seal cup 160 has a lip 250 that extends into the through bore 220. Likewise seal cup 162 has a lip 252 that extends into through bore 254. In an alternative embodiment, the lips 250 and 252 are eliminated.

Figure 9:
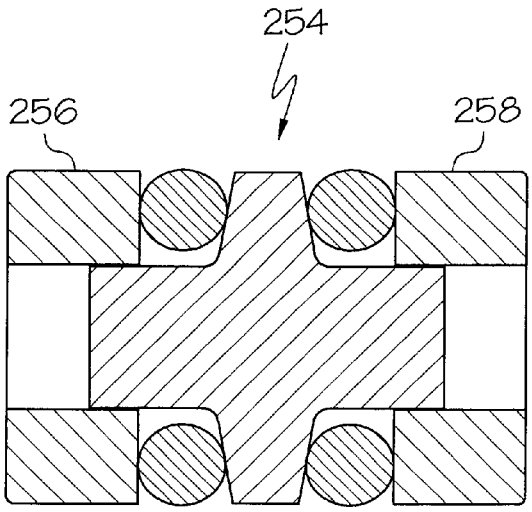
FIG. 9 is a sectional view of a valve with an alternative embodiment of the dual energized hydroseal. The valve is in the closed position in an unpressurized state.

FIG. 9 is a section view of an alternative embodiment 254 of the seal assembly. The seal assembly 254 is the same as seal assembly 36, except first seal cup 256 and second seal cup 258 do not have lips 250 or 252. In all other respects, the seal assembly 254 functions in the same fashion as seal assembly 36.

What is claimed is:

1. A seal assembly positioned in a transverse bore of a seal carrier in a valve, the seal carrier shifting from a closed position to an open position, and the valve having a pair of opposing seal plates, the seal assembly being aligned with the seal plates when the seal carrier is in the closed position, and the seal assembly being out of alignment with the seal plates when the seal carrier is in the open position, the seal assembly being exposed alternatively to supply pressure and to function pressure, the seal assembly comprising:

a seal spool having a central circular collar and a transverse axle, a first end of the axle extending from one side of the collar and a second end of the axle extending from the opposite side of the collar;

a first seal cup having a through bore, a portion of the bore being sized and arranged to receive the first end of the axle, the seal cup having a sealing surface to seal against the opposing seal plate;

a second seal cup having a through bore, a portion of he bore being sized and arranged to receive the second end of the axle, the second seal cup having a sealing surface to seal against the opposing seal plate;

a first O-ring positioned around the first end of the axle;

a second O-ring positioned around the second end of the axle; and the first O-ring compressed by the first seal cup against the collar and the second O-ring compressed by the second seal cup against the collar so the O-rings act as seals and as springs urging the seal cups into contact with the opposing seal plates.

2. The apparatus of claim 1 wherein the O-rings are compressed axially more than 38.5 percent between the collar and the seal cups.

3. The apparatus of claim 1 wherein the seal assembly is exposed to supply pressure and such pressure enters the through bores in each seal cup energizing both O-rings and forcing them out of contact with the axle and into sealing contact with the transverse bore of the seal carrier and the seal cups so supply pressure can force both seal cups into sealing engagement with the seal plates.

4. The apparatus of claim 3 wherein the seal assembly is exposed to function pressure and such pressure enters the transverse bore of the seal carrier energizing both O-rings and forcing them out of contact with the transverse bore and into sealing contact with the seal spool and the seal cups so function pressure can force both seal cups into sealing contact with the seal plates.

5. A seal assembly positioned in a transverse bore of a seal carrier in a valve, the seal carrier shifting from a closed position to an open position, and the valve having a pair of opposing seal plates, the seal assembly being aligned with the seal plates when the seal carrier is in the closed position, and the seal assembly being out of alignment with the seal plates when the seal carrier is in the open position, the seal assembly being exposed alternatively to supply pressure and to function pressure, the seal assembly comprising:

a seal spool having a central circular collar and a transverse axle, a first end of the axle extending from one side of the collar and a second end of the axle extending from the opposite side of the collar;

a first seal cup having a through bore, a portion of the bore being sized and arranged to receive the first end of the axle, the seal cup having a sealing surface to seal against the opposing seal plate;

a second seal cup having a through bore, a portion of he bore being sized and arranged to receive the second end of the axle, the second seal cup having a sealing surface to seal against the opposing seal plate;

a first O-ring positioned around the first end of the axle;

a second O-ring positioned around the second end of the axle.

6. The apparatus of claim 5 wherein the O-rings are squeezed axially more than 38.5 percent between the collar and the seal cups.

7. The apparatus of claim 5 wherein the seal assembly is exposed to supply pressure and such pressure enters the through bores in each seal cup energizing both O-rings and forcing them out of contact with the axle and into sealing contact with the transverse bore of the seal carrier and the seal cups so supply pressure can force both seal cups into sealing engagement with the seal plates.

8. The apparatus of claim 7 wherein the seal assembly is exposed to function pressure and such pressure enters the transverse bore of the seal carrier energizing both O-rings and forcing them out of contact with the transverse bore and into sealing contact with the seal spool and the seal cups so function pressure can force both seal cups into sealing contact with the seal plates.

9. A dirty fluid valve with bi-directional seal assembly positioned in a downhole tool for sampling of wellbore fluids and storage of such wellbore fluids in a sample collection bottle, the dirty fluid valve being connected to a pilot open valve and a pilot close valve to open and close the dirty fluid valve, both pilot valves connected to a source of pressurized pilot fluid, the dirty fluid valve comprising:

a body having a longitudinal bore sized and arranged to receive a seal carrier, the seal carrier being in contact with a spring urging the seal carrier into a closed position;

the body defining at least one open port in fluid communication with an open chamber, both the open port and the open chamber being in fluid communication with the pilot open valve to shift the seal carrier to an open position in response to pressurized pilot fluid entering the open chamber to allow wellbore fluids to pass through the dirty fluid valve and into the sample collection bottle;

the body defining at least one close port in fluid communication with a close chamber, both the close port and the close chamber in fluid communication with the pilot close valve to shift the seal carrier back to the closed position in response to pressurized pilot fluid entering the close chamber;

a pair of opposing seal plates positioned in the body, each seal plate having a through hole in fluid communication with a supply port in the body, the supply ports being in communication with the wellbore fluids;

a pair of opposing function ports in the body, the function ports in fluid communication with the longitudinal bore and the sample collection bottle;

the seal carrier having a transverse bore sized and arranged to receive a bi-directional seal assembly comprising:

a seal spool having a central circular collar and a transverse axle, a first end of the axle extending from one side of the collar and a second end of the axle extending from the opposite side of the collar;

a first seal cup having a through bore, a portion of the bore being sized and arranged to receive the first end of the axle, the seal cup having a sealing surface to seal against the opposing seal plate;

a second seal cup having a through bore, a portion of he bore being sized and arranged to receive the second end of the axle, the second seal cup having a sealing surface to seal against the opposing seal plate;

a first O-ring positioned around the first end of the axle; and a second O-ring positioned around the second end of the axle.

10. The apparatus of claim 9 wherein the O-rings are squeezed axially more than 38.5 percent between the collar and the seal cups.

11. The apparatus of claim 9 wherein the seal assembly is exposed to supply pressure and such pressure enters the through bores in each seal cup energizing both O-rings and forcing them out of contact with the axle and into sealing contact with the transverse bore of the seal carrier and the seal cups so supply pressure can force both seal cups into sealing engagement with the seal plates.

12. The apparatus of claim 11 wherein the seal assembly is exposed to function pressure and such pressure enters the transverse bore of the seal carrier energizing both O-rings and forcing them out of contact with the transverse bore and into sealing contact with the seal spool and the seal cups so function pressure can force both seal cups into sealing contact with the seal plates.

13. A seal assembly positioned in a transverse bore of a seal carrier in a valve, the seal carrier shifting from a closed position to an open position, and the valve having a pair of opposing seal plates, the seal assembly being aligned with the seal plates when the seal carrier is in the closed position, and the seal assembly being out of alignment with the seal plates when the seal carrier is in the open position, the seal assembly being exposed alternatively to supply pressure and to function pressure, the seal assembly comprising:

a seal spool having a central circular collar and a transverse axle, a first end of the axle extending from a first O-ring engaging surface of the collar and a second end of the axle extending from a second O-ring engaging surface of the collar, said first and second O-ring engaging surfaces each being inclined to provide collar and thickness increasing from an outer periphery thereof to the axle;

a first seal cup having a through bore, a portion of the bore being sized and arranged to receive the first end of the axle, the seal cup having a sealing surface to seal against the opposing seal plate;

a second seal cup having a through bore, a portion of the bore being sized and arranged to receive the second end of the axle, the second seal cup having a sealing surface to seal against the opposing seal plate;

a first O-ring positioned around the first end of the axle;

a second O-ring positioned around the second end of the axle; and the first O-ring compressed by the first seal cup against the collar and the second O-ring compressed by the second seal cup against the collar so the O-rings act as seals and as springs urging the seal cups into contact with the opposing seal plates.

14. The apparatus of claim 13 wherein the O-rings are compressed axially more than 38.5 percent between the collar and the seal cups.

15. The apparatus of claim 13 wherein the seal assembly is exposed to supply pressure and such pressure enters the through bores in each seal cup energizing both O-rings and forcing them out of contact with the axle and into sealing contact with the transverse bore of the seal carrier and the seal cups so supply pressure can force both seal cups into sealing engagement with the seal plates.

16. The apparatus of claim 15 wherein the seal assembly is exposed to function pressure and such pressure enters the transverse bore of the seal carrier energizing both O-rings and forcing them out of contact with the transverse bore and into sealing contact with the seal spool and the seal cups so function pressure can force both seal cups into sealing contact with the seal plates.

17. The apparatus of claim 13 wherein the incline of the first and second O-ring engaging surfaces is approximately 10° from a plane transverse to the longitudinal axis, of the axle.

18. A seal assembly positioned in a transverse bore of a seal carrier in a valve, the seal carrier shifting from a closed position to an open position, and the valve having a pair of opposing seal plates, the seal assembly being aligned with the seal plates when the seal carrier is in the closed position, and the seal assembly being out of alignment with the seal plates when the seal carrier is in the open position, the seal assembly being exposed alternatively to supply pressure and to function pressure, the seal assembly comprising:

a seal spool having a central circular collar and a transverse axle, a first end of the axle extending from a first O-ring engaging surface of the collar and a second end of the axle extending from a second O-ring engaging surface side of the collar, said first and second O-ring engaging surfaces each being inclined to provide collar thickness increasing from an outer periphery thereof to the axle;

a first seal cup having a through bore, a portion of the bore being sized and arranged to receive the first end of the axle, the seal cup having a sealing surface to seal against the opposing seal plate;

a second seal cup having a through bore, a portion of the bore being sized and arranged to receive the second end of the axle, the second seal cup having a sealing surface to seal against the opposing seal plate;

a first O-ring positioned around the first end of the axle;

a second O-ring positioned around the second end of the axle.

19. The apparatus of claim 18 wherein the O-rings are squeezed axially more than 38.5 percent between the collar and the seal cups.

20. The apparatus of claim 18 wherein the seal assembly is exposed to supply pressure and such pressure enters the through bores in each seal cup energizing both O-rings and forcing them out of contact with the axle and into sealing contact with the transverse bore of the seal carrier and the seal cups so supply pressure can force both seal cups into sealing engagement with the seal plates.

21. The apparatus of claim 20 wherein the seal assembly is exposed to function pressure and such pressure enters the transverse bore of the seal carrier energizing both O-rings and forcing them out of contact with the transverse bore and into sealing contact with the seal spool and the seal cups so function pressure can force both seal cups into sealing contact with the seal plates.

22. A dirty fluid valve with bi-directional seal assembly positioned in a downhole tool for sampling of wellbore fluids and storage of such wellbore fluids in a sample collection bottle, the dirty fluid valve being connected to a pilot open valve and a pilot close valve to open and close the dirty fluid valve, both pilot valves connected to a source of pressurized pilot fluid, the dirty fluid valve comprising:

a body having a longitudinal bore sized and arranged to receive a seal carrier, the seal carrier being in contact with a spring urging the seal carrier into a closed position;

the body defining at least one open port in fluid communication with an open chamber, both the open port and the open chamber being in fluid communication with the pilot open valve to shift the seal carrier to an open position in response to pressurized pilot fluid entering the open chamber to allow wellbore fluids to pass through the dirty fluid valve and into the sample collection bottle;

the body defining at least one close port in fluid communication with a close chamber, both the close port and the close chamber in fluid communication with the pilot close valve to shift the seal carrier back to the closed position in response to pressurized pilot fluid entering the close chamber;

a pair of opposing seal plates positioned in the body, each seal plate having a through hole in fluid communication with a supply port in the body, the supply ports being in communication with the wellbore fluids;

a pair of opposing function ports in the body, the function ports in fluid communication with the longitudinal bore and the sample collection bottle;

the seal carrier having a transverse bore sized and arranged to receive a bi-directional seal assembly comprising:

a seal spool having a central circular collar and a transverse axle, a first end of the axle extending from a first O-ring engaging surface of the collar and a second end of the axle extending from a second O-ring engaging surface of the collar, said first and second O-ring engaging surfaces each being inclined to provide collar thickness increasing from an outer periphery thereof to the axle;

a first seal cup having a through bore, a portion of the bore being sized and arranged to receive the first end of the axle, the seal cup having a sealing surface to seal against the opposing seal plate;

a second seal cup having a through bore, a portion of the bore being sized and arranged to receive the second end of the axle, the second seal cup having a sealing surface to seal against the opposing seal plate;

a first O-ring positioned around the first end of the axle; and a second O-ring positioned around the second end of the axle.

23. The apparatus of claim 22 wherein the O-rings are squeezed axially more than 38.5 percent between the collar and the seal cups.

24. The apparatus of claim 22 wherein the seal assembly is exposed to supply pressure and such pressure enters the through bores in each seal cup energizing both O-rings and forcing them out of contact with the axle and into sealing contact with the transverse bore of the seal carrier and the seal cups so supply pressure can force both seal cups into sealing engagement with the seal plates.

25. The apparatus of claim 22 wherein the seal assembly is exposed to function pressure and such pressure enters the transverse bore of the seal carrier energizing both O-rings and forcing them out of contact with the transverse bore and into sealing contact with the seal spool and the seal cups so function pressure can force both seal cups into sealing contact with the seal plates.

26. A dirty fluid valve with bi-directional seal assembly positioned in a downhole tool for sampling of wellbore fluids and storage of such wellbore fluids in a sample collection bottle, the dirty fluid valve being connected to a pilot open valve and a pilot close valve to open and close the dirty fluid valve, both pilot valves connected to a source of pressurized pilot fluid, the dirty fluid valve comprising:

a body having a longitudinal bore sized and arranged to receive a seal carrier, the seal carrier being in contact with a spring urging the seal carrier into a closed position;

the body defining at least one open port in fluid communication with an open chamber, both the open port and the open chamber being in fluid communication with the pilot open valve to shift the seal carrier to an open position in response to pressurized pilot fluid entering the open chamber to allow wellbore fluids to pass through the dirty fluid valve and into the sample collection bottle;

the body defining at least one close port in fluid communication with a close chamber, both the close port and the close chamber in fluid communication with the pilot close valve to shift the seal carrier back to the closed position in response to pressurized pilot fluid entering the close chamber;

a pair of opposing seal plates carried by the body, each seal plate having a through hole in fluid communication with a supply port in the body, the supply ports being in communication with the wellbore fluids said seal plates each having first and second ends with a gap at at least one of the first and second ends;

at least one function port in the body, the function port in fluid communication with the longitudinal bore and the sample collection bottle;

the seal carrier having a transverse bore sized and arranged to receive a bi-directional seal assembly comprising:

a seal spool having a central circular collar and a transverse axle, a first end of the axle extending from one side of the collar and a second end of the axle extending from the opposite side of the collar;

a first seal up having a through bore, a portion of the bore being sized and arranged to receive the first end of the axle, the seal cup having a sealing surface to seal against the first end of the opposing seal plate;

a second seal cup having a through bore, a portion of he bore being sized and arranged to receive the second end of the axle, the second seal cup having a sealing surface to seal against the first end of the opposing seal plate;

a first O-ring positioned around the first end of the axle; and a second O-ring positioned around the second end of the axle.

27. The appartus of claim 26 wherein the O-rings are squeezed axially more than 38.5 percent between the collar and the seal cups.

28. The apparatus of claim 26 wherein the seal assembly is exposed to supply pressure and such pressure enters the through bores in each seal cup energizing both O-rings and forcing them out of contact with the axle and into sealing contact with the transverse bore of the seal carrier and the seal cups so supply pressure can force both seal cups int sealing engagement with the seal plates.

29. The Apparatus of claim 28 wherein the seal assembly is exposed to function pressure and such pressure enters the transverse bore of the seal carrier energizing both O-rings and forcing them out of contact with the transverse bore and into sealing contact with the seal spool and the seal cups so function pressure can force both cups into sealing contact with the seal plates.

30. The apparants of claim 26 wherein said seal plates each having a gap at each of the first and second ends with the gap at the first ends being between the body and the first ends.

* * * * *

UNITED STATES PATENT AND TRADEMARK OFFICE

CERTIFICATE OF CORRECTION

PATENT NO. : 6,702,024 B2
DATED : March 9, 2004
INVENTOR(S) : Neugebauer, Thomas W.

It is certified that error appears in the above-identified patent and that said Letters Patent is hereby corrected as shown below:

Title page,
Item [73], Assignee, delete "Cilmore Valve Co., Ltd." and replace with
-- Gilmore Valve Co., Ltd. --

Column 7,
Lines 27 and 48, at the end of the sentence delete "he" and replace with -- the --

Column 8,
Line 30, at the beginning of the sentence delete "he" and replace with -- the --

Column 12,
Line 17, after the word "seal" delete "up" and replace with -- cup --
Line 38, at the end of the sentence delete "int" and replace with -- into --
Lind 47, after the word "the" delete "apparants" and replace with -- apparatus --

Signed and Sealed this

Fifth Day of October, 2004

JON W. DUDAS
*Director of the United States Patent and Trademark Office*